US005864811A

United States Patent [19]

Tran et al.

[11] Patent Number: 5,864,811

[45] Date of Patent: Jan. 26, 1999

[54] AUDIO CIRCUIT FOR USE WITH SYNTHESIZED AUDIO SIGNALS AND SIGNALS FROM A MODEM

[75] Inventors: Thanh T. Tran, Houston; John A. Landry, Tomball; Robert F. Watts, Houston, all of Tex.

[73] Assignee: Compaq Computer Corporation, Houston, Tex.

[21] Appl. No.: 748,268

[22] Filed: Nov. 13, 1996

[51] Int. Cl.[6] ..... G10L 9/00

[52] U.S. Cl. ..... 704/258; 104/275; 104/270

[58] Field of Search ..... 704/258, 275, 704/270; 381/119

[56] References Cited

U.S. PATENT DOCUMENTS 5,402,499 3/1995 Robison et al. ..... 381/119

5,515,442 5/1996 Dombrowski, Jr. ..... 381/11

*Primary Examiner*—David R. Hudspeth

*Assistant Examiner*—Susan Wieland

[57] ABSTRACT

An audio circuit for a computer includes a bidirectional modem connection, a microphone input, first and second audio output channels, and an audio synthesizing circuit arranged to produce first and second synthesized audio channels. In a first mode of operation the first synthesized audio channel is applied to the first audio output channel and the second synthesized audio channel is applied to the second audio output channel. In a second mode of operation the first and second synthesized audio channels are combined into a monotonic signal and applied to the second audio output channel, and audio signals from the bidirectional modem connection are applied to the first audio output channel.

12 Claims, 3 Drawing Sheets

FIG. 1
(PRIOR ART)
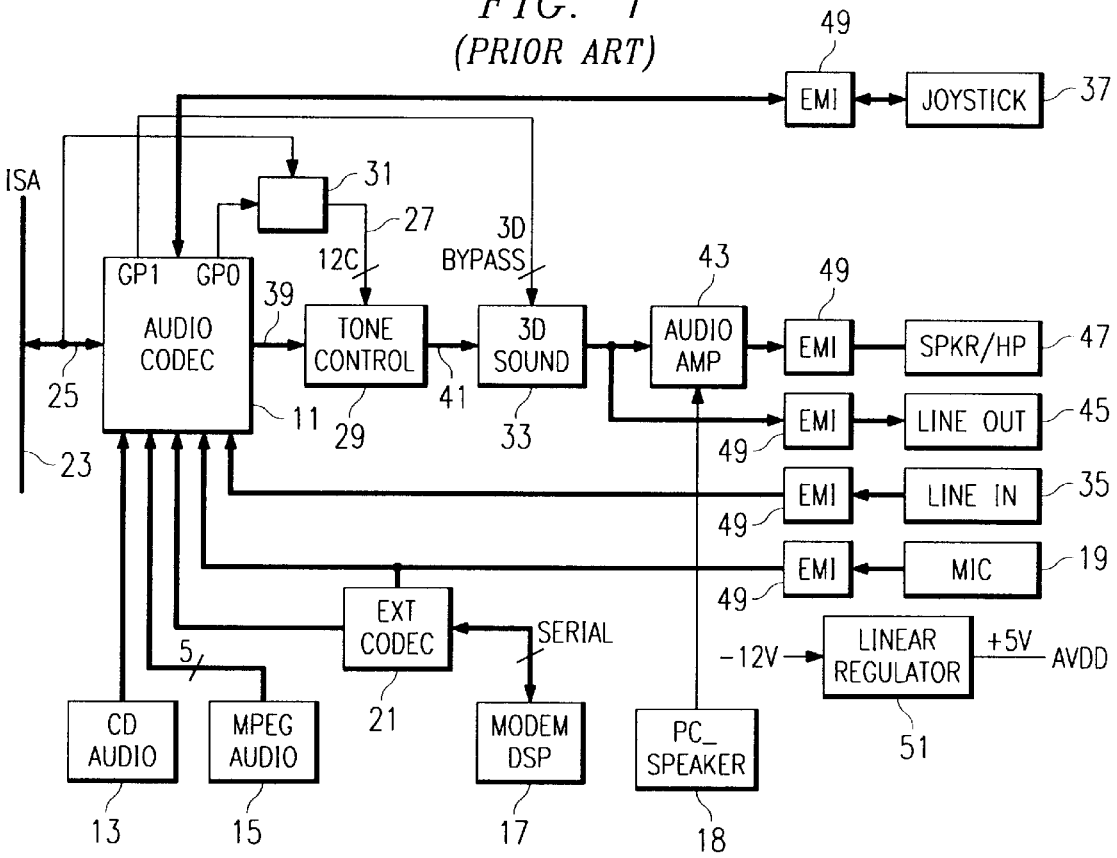
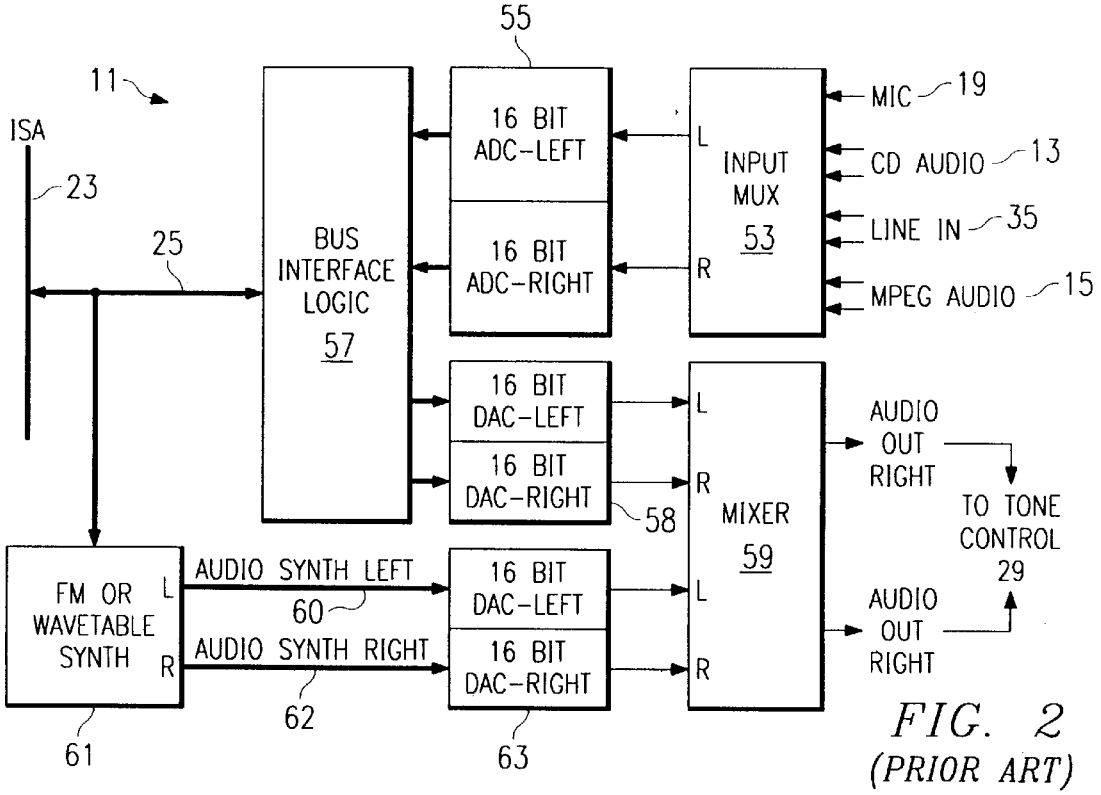
FIG. 2
(PRIOR ART)

AUDIO CIRCUIT FOR USE WITH SYNTHESIZED AUDIO SIGNALS AND SIGNALS FROM A MODEM

FIELD OF THE INVENTION

The invention relates to audio circuits for computers.

BACKGROUND OF THE INVENTION

The demands from computer users for multimedia capability are increasing rapidly. Today's computers must integrate numerous functionalities including, e.g., CD-ROM, computerized movies, high-fidelity sound, gaming functions, and speakerphone capability. The computer's audio circuit must be able to interface with each of these sources, perform the necessary conversions between formats and sample rates, and direct the audio to the desired output. Integrating these various functionalities creates complexity and increases the expense of the audio circuit. In addition, integrating communications such as speakerphone capability with computer audio (such as .WAV files developed by MicroSoft) requires multiple coder/decoders (codecs) and various discrete components. This results in added costs, and also generates problems with respect to audible noise coupling and high frequency radiation (EMI).

One computer that integrates audio information from various sources is the Compaq Presario®. A block diagram of the audio circuit of the Presario® is shown in prior art FIG. 1. The audio circuit is centered around audio codec 11. Audio codec 11 may be, for example, the ES1888 chip made by ESS Technology. Audio codec 11 receives audio from CD audio input 13, MPEG audio input 15, modem digital signal processor (DSP) connection 17 (i.e., audio from a modem connected to a phone line for the speakerphone), and microphone 19. Serial data from connection 17 are applied to audio codec 11 and audio from microphone 19 is sent to connection 17 via an external codec 21. External codec 21 may be, for example, an AT&T 7525 codec. The external codec 21 allows the audio circuit to function as a full-duplex speakerphone. Additional inputs to audio codec 11 include line in 35, which is typically a jack on the exterior of the computer or monitor housing (not shown) that allows the user to apply audio signals to the audio circuit. Joystick 37 (or other game control device) also interfaces with audio codec 11.

Audio codec 11 communicates with ISA bus 23 via bus 25. An $I^2C$ bus 27 is derived from bus 25 and is applied to tone control circuit 29 via interface logic 31. Tone control circuit 29 selectively processes the audio produced by audio codec 11 and applies its output to 3D sound circuit 33, as explained in more detail below. $I^2C$ is an industry standard communication link comprising a clock signal and a data signal. General purpose I/O output one (GP1) from audio codec 11 is used to selectively bypass 3D sound circuit 33. Addressable registers of the audio codec 11 are used to control and access the $1^2C$ bus 27, and audio codec 11 uses a general purpose I/O output zero (GP0) to indicate decoded reads from or writes to these registers. The GP0 output of the audio codec 11 is connected to the logic 31.

Audio codec 11 generates an audio output on line 39 which applied to tone control circuit 29. Tone control circuit 29 may be, for example, the TEA6330 chip available from Phillips. By way of the logic 31, tone control circuit 29 can be controlled remotely via ISA bus 23 and $I^2C$ communication link 27. Tone control circuit 29 generates an output on line 41, which is in turn applied to 3D sound circuit 33. 3D sound circuit 33 may be, for example, the AN7395 chip available from Panasonic. The 3D sound circuit may be selectively bypassed by activating GP1 of audio codec 11. The output of 3D sound circuit 33 is applied to audio amp 43 and to line out 45. Line out 45 is typically a jack on the exterior of the computer or monitor housing. Audio amplifier 43 amplifies the audio signal and outputs it to speaker/headphone output 47.

To reduce EMI and noise coupling within the system, all analog inputs and outputs are isolated from audio codec 11 via an EMI filter 49. EMI filter 49 may be any of the filters known in the art, including for example a pi-filter having two capacitors and a ferrite bead. Power for the audio circuit is supplied by linear regulator 51, which produces the clean 5-volt DC output necessary for analog components. The linear regulator may be, for example, the LM317SX regulator available from National Semiconductor.

A block diagram of the internal structure of audio codec 11 is provided in prior art FIG. 2. Inputs from microphone 19, CD audio 13, line in 35, and MPEG audio 15 are applied to an input multiplexor 53. Input multiplexor 53 outputs left and right analog audio signals that are applied to the left and right channels of analog-to-digital (A/D) converter 55. A/D converter 55 comprises two 16-bit A/D converters (e.g., a delta/sigma converter); one for each channel. The resulting digital left and right audio signals are applied to bus interface logic 57, which is in communication with ISA bus 23 via link 25.

Digital audio output from bus interface logic 57 is applied to digital-to-analog (D/A) converter 58. Converter 57 comprises two 16-bit D/A; one for each channel. The analog outputs from D/A converter 57 are applied to mixer 59.

An FM or wave table audio synthesizer 61 is also provided in communication with ISA bus 23. Synthesized left (60) and right (62) audio from audio synthesizer 61 are applied to D/A converter 63, which has the same structure as that of D/A converter 57. The outputs of D/A converter 63 are also applied to mixer 59. Mixer 59 mixes the left and right channels of the outputs of converters 57 and 63, respectively, and produces audio out left and audio out right signals that are then applied to tone control circuit 29, as explained previously.

SUMMARY OF THE INVENTION

In one aspect, the invention relates to an audio codec, comprising: a bidirectional modem connection; a microphone input; first and second audio output channels; and an audio synthesizing circuit arranged to produce first and second synthesized audio channels; wherein in a first mode of operation the first synthesized audio channel is applied to the first audio output channel and the second synthesized audio channel is applied to the second audio output channel; and wherein in a second mode of operation the first and second synthesized audio channels are combined into a monotonic signal and applied to the second audio output channel, and audio signals from the bidirectional modem connection are applied to the first audio output channel.

In another aspect, the invention relates to an audio circuit for a computer, comprising: a CD audio input and a microphone input; a bidirectional modem connection; an audio codec arranged to communicate with the CD audio input, the microphone input, and the bidirectional modem connection and to generate first and second audio output channels; and an audio amplifier for amplifying the first and second audio output channels and applying the amplified first and second audio output channels to an output port. The audio codec further comprises: an audio synthesizing circuit arranged to produce first and second synthesized audio channels; wherein in a first mode of operation the first synthesized audio channel is applied to the first audio output channel and the second synthesized channel is applied to the second audio output channel; and wherein in a second mode of operation the first and second synthesized audio channels are combined into a monotonic signal and applied to the second audio output channel, and signals from the bidirectional modem connection are applied to the first audio output channel.

In another aspect, the invention relates to a method of simultaneously allowing speakerphone operation and generation of synthesized audio signals in an audio circuit, the audio circuit having a bidirectional modem connection, a microphone input, first and second audio output channels, and an audio synthesizing circuit, comprising the steps of: producing first and second synthesized audio channels using the audio synthesizing circuit; applying audio signals from the microphone input to the bidirectional modem connection; receiving audio signals from the bidirectional modem connection; combining the first and second synthesized audio channels into a monotonic signal and applying the monotonic signal to the second audio output channel; and applying the audio signals from the bidirectional modem connection to the first audio output channel.

In another aspect, the invention relates to a computer system having a central processing unit, a modem, a microphone, a CD ROM drive, and an audio circuit. The audio circuit has a CD audio input coupled to the CD ROM drive and a microphone input coupled to the microphone. The audio circuit also has a bidirectional modem connection coupled to the modem. The audio circuit also has an audio codec arranged to communicate with the CD audio input, the microphone input, and the bidirectional modem connection and to generate first and second audio output channels. The audio circuit also has an audio amplifier for amplifying the first and second audio output channels and applying the amplified first and second audio output channels to an output port. The audio codec has an audio synthesizing circuit arranged to produce first and second synthesized audio channels. In a first mode of operation the first synthesized audio channel is applied to the first audio output channel and the second synthesized channel is applied to the second audio output channel. In a second mode of operation the first and second synthesized audio channels are combined into a monotonic signal and applied to the second audio output channel, and signals from the bidirectional modem connection are applied to the first audio output channel.

BRIEF DESCRIPTION OF THE DRAWINGS

FIG. 1 is a block diagram of a prior art audio circuit;

FIG. 2 is a block diagram of a prior art audio codec;

DESCRIPTION OF THE PREFERRED EMBODIMENTS

Embodiments of the invention will be described in detail below with reference to the accompanying figures.

Figure 3:
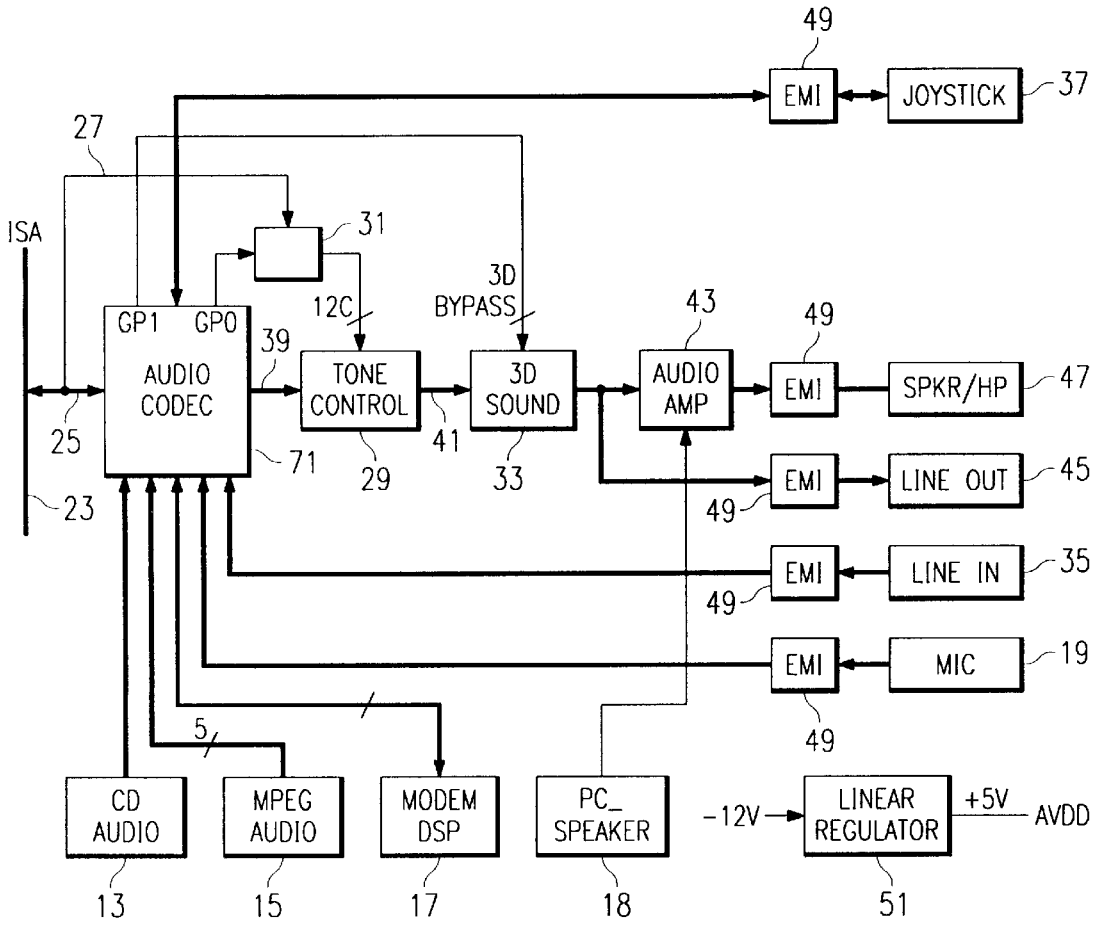
FIG. 3 is a block diagram of an audio circuit in accordance with an embodiment of the invention.

An audio circuit in accordance with one embodiment of the invention is shown in FIG. 3. Like elements with respect to prior art FIG. 1 are given the same reference numerals. There are two differences between the circuit of FIG. 3 and that of FIG. 1. The first is that an audio codec 71 in accordance with the invention replaces the audio codec 11 of the prior art. Audio codec 71 will be described in more detail below. The second difference is that, as a result of the improvements and advantages obtained by audio codec 71, the additional external codec 21 that was necessary for speakerphone operation in the circuit of FIG. 1 is no longer necessary. As shown in FIG. 3, the speakerphone (modem DSP) connection is now made directly to the audio codec 71. Thus, complexity is reduced, and the expense of an additional codec is avoided.

Figure 4:
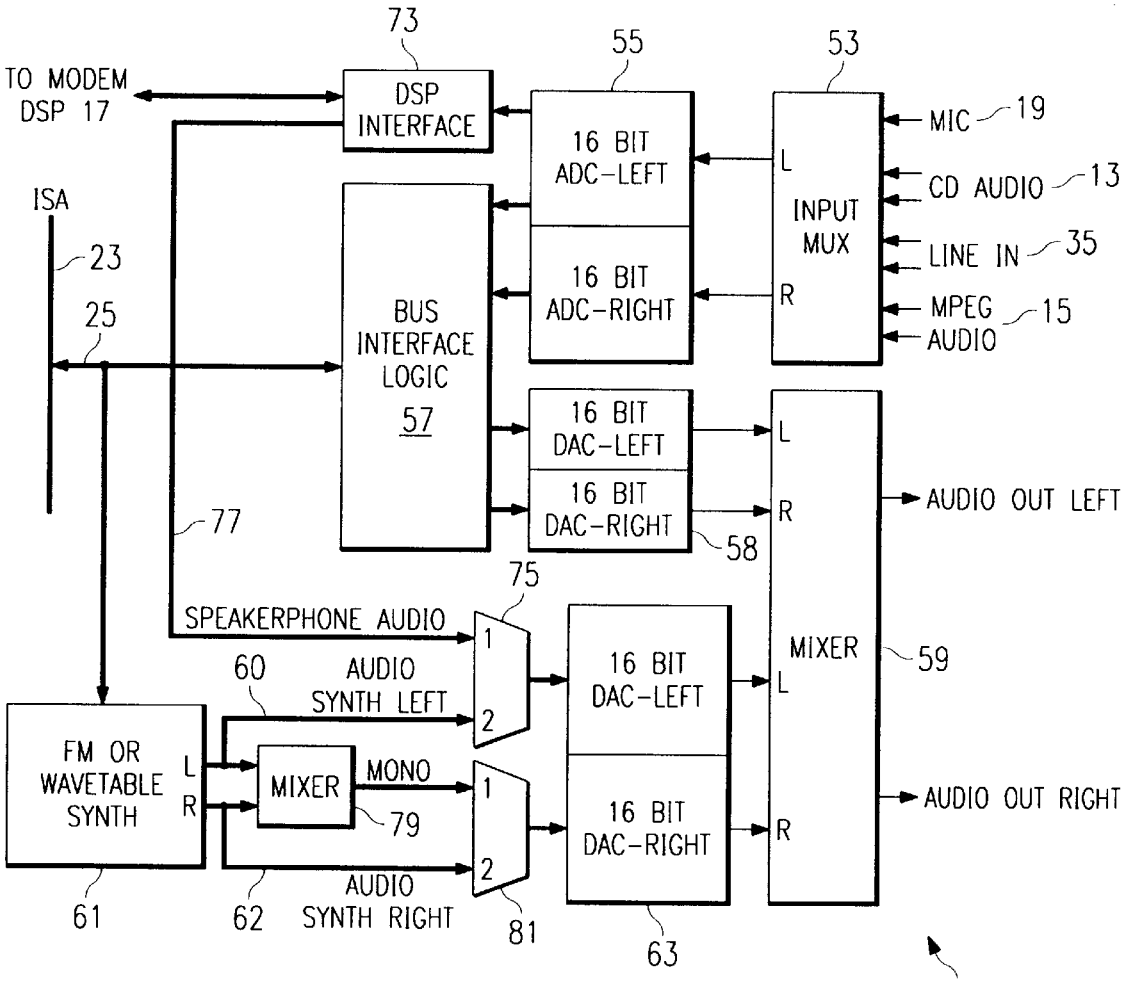
FIG. 4 is a block diagram of an audio codec in accordance with an embodiment of the invention.

A block diagram of audio codec 71 is provided in FIG. 4. Like elements with respect to codec 11 shown in FIG. 2 are given the same reference numerals.

DSP interface 73 is provided that interfaces directly with modem DSP 17. DSP interface 73 may, for example, function similarly to the AT&T 7525. When the audio circuit is in speakerphone mode, audio signals input via microphone 19 are coded into the left channel of input multiplexor 53, and are converted to digital signals by the left channel of A/D converter 55. The digital output of the left channel of A/D converter 55 is applied both to bus interface logic 57 (as was the case in FIG. 2) and to DSP interface 73. The digital audio is then applied directly to modem DSP 17. At the same time, audio from modem DSP 17 is received by DSP interface 73, and is forwarded to a two channel multiplexor 75 via speakerphone audio line 77. The output of multiplexor 75 is applied to the left channel of D/A converter 63. Accordingly, when the speakerphone audio channel is selected by multiplexor 75, the digital audio from DSP interface 73 is converted to analog signals by D/A converter 63, and is output as "audio out left" by mixer 59.

The addition of DSP interface 73, speakerphone audio line 77, and multiplexor 75 allows full duplex speakerphone operation through the audio circuit without requiring a separate external codec. Because the speakerphone audio is output on the left channel only, the microphone 19 is preferably disposed as far away from the left speaker as possible to prevent feedback. Alternatively, the output of the multiplexor 75 may be applied to the right channel of the D/A converter 63 and output as "audio out right" by the mixer 59. For this configuration, the speakerphone audio is output on the right channel, and the microphone 19 is preferably disposed as far away from the right speaker as possible to prevent feedback.

One of the desired abilities of today's multimedia computers is the ability to perform "telegaming". Telegaming involves playing a game on the computer while conversing with other players at remote locations via telephone. Thus, it may be desirable to maintain the audio output/effects of a game while operating in full duplex speakerphone mode. These audio effects might include a combination of CD audio, synthesized audio, and audio file (e.g., a .WAV sound file developed by Microsoft) playback. In the audio circuit of prior art FIG. 1, this could be achieved only through the use of external codec 21. However, in accordance with the invention, as a result of DSP interface 73 and additional circuitry described below, telegaming (which includes these audio effects) and simultaneous operation in a full duplex speakerphone mode can be simultaneously achieved without an additional external codec.

Referring to FIG. 4, the left channel output of audio synthesizer 61 is applied to the second input of multiplexor 75 and to one input of a mixer 79. The right channel output of audio synthesizer 61 is applied to one input of a second two-channel multiplexor 81, and is also applied to the mixer 79. Mixer 79 adds the left and right audio to produce a mono output. The mono output is applied to the other input of multiplexor 81. The output of multiplexor 81 is applied to the right channel of the D/A converter 63. Alternatively, if the "audio output right" of the mixer 59 is used to carry the output of the mixer 75, the output of the multiplexor 81 is applied to the left channel of the D/A converter 63.

Operation of audio codec 71 is as follows. During normal operation, digital audio signals received from MIC 19, CD audio 13, line in 35, or MPEG audio 15 via bus interface logic 57 are converted to audio signals by D/A converter 57 and output via mixer 59. If it is desired to produce synthesized audio, the left and right synthesized audio channels are output by audio synthesizer 61 and are selected by multiplexors 75 and 81. The left and right synthesized audio signals are then converted to analog by D/A converter 63 and mixed with the audio output from D/A converter 58 by mixer 59.

If the user enters speakerphone mode, multiplexor 75 selects the speakerphone audio line 77, and thus takes over the left channel of D/A converter 63. If it is then desired to play back synthesized audio while in speakerphone mode, multiplexor 81 selects the output of mixer 79, which is a monotonic digital signal representing the sum of the left and right synthesized audio channels. The output of multiplexor 81 is then converted to analog by the right channel of D/A converter 63 and output to the right speaker (or other output) via mixer 59. Thus, audio playback from games and the like can be heard through the right speaker, while audio from the full duplex speakerphone operation is heard through the left speaker. As discussed above, this configuration may be switched so that audio from the full duplex speakerphone is heard through the right speaker while the audio playback from the games and the like are heard from the left speaker. The simultaneous operation of the audio playback and the speakerphone is achieved without requiring additional external circuitry such as an external codec. Thus, complexity and expense of the audio circuit is reduced.

Figure 5:
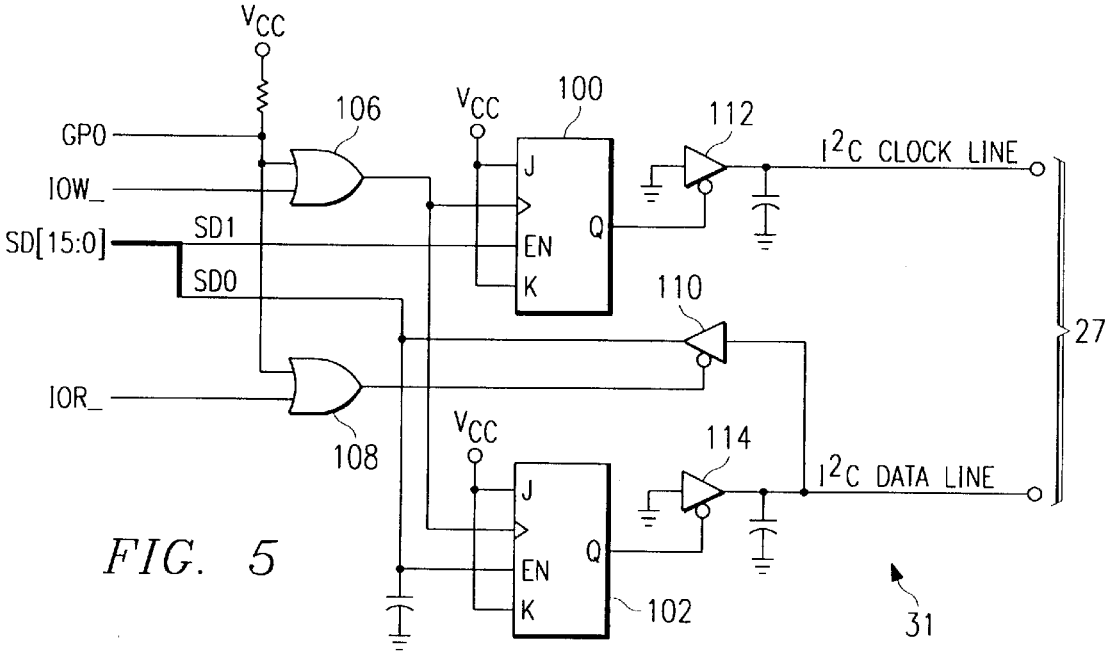
FIG. 5 is a schematic diagram of circuitry of the audio codec in accordance with an embodiment of the invention.

For purposes of controlling and accessing the $I^2C$ bus 27, the codec 71 has addressable $I^2C$ registers (not shown). The codec 71 indicates writes to or reads from the $I^2C$ registers by driving low a general purpose I/O output zero (GP0) of the codec 71. As shown in FIG. 5, the interface logic 31 includes a JK-type flip-flop 100 that is configured as a toggle (T-type) flip-flop. The flip-flop 100 has its non-inverting output connected to the enable input of a tristate buffer 112. The tri-state buffer 112 has its input coupled to ground, and the output of the buffer 112 is coupled to the clock line of the $I^2C$ bus 27.

By accessing one of the $I^2C$ registers of the codec 71, a bus device coupled to the ISA bus 23 can control the clock line of the $I^2C$ bus 27. One input of an OR gate 106 receives a write strobe signal $I_{ow}$_ (asserted low to indicate a write cycle) from the ISA bus 23, and another input of the OR gate 106 is connected to the GP0 output of the audio codec 71. The output of the OR gate 106 is connected to the clock input of the flip-flop 100. The enable input of the flip-flop 100 is coupled to data line one (SD1) of the data bus (SD[15:0]) of the ISA bus 23. Therefore, via a write by an ISA bus device to one of the $I^2C$ registers, the SD1 line is used to selectively negate the $I^2C$ clock line (otherwise pulled high).

For purposes of writing data to the $I^2C$ data line, a JK-type flip-flop 102 is configured as a toggle (T-type) flip-flop. The non-inverting output of the flip-flop 102 is connected to the enable output of a tri-state buffer 114 having its input grounded and its output connected to the $I^2C$ data line. The enable input of the flip-flop 102 is connected to data line zero (SD0) of the data bus of the ISA bus 23. The clock input of the flip-flop 102 is connected to the output of the OR gate 106. Therefore, via a write to one of the $I^2C$ registers, an ISA bus device can selectively negate the $I^2C$ data line (otherwise pulled high).

For purposes of reading data from the $I^2C$ data line, the logic 31 includes a tri-state buffer 110 having its input connected to the $I^2C$ data line and its output connected to the SD0 line. The enable input of the tri-state buffer 110 is connected to the output of an OR gate 108. One input of the OR gate 108 receives a read strobe signal IOR_ (asserted low to indicate a read cycle) from the ISA bus 23, and another input of the OR gate 108 is connected to the GP0 output of the codec 71. Therefore, on a read by an ISA bus device from one of the $I^2C$ registers, the SD0 line is used to indicate the value of the $I^2C$ data line.

Various embodiments of the invention have been shown and described above. However, the invention is not so limited. Numerous variations in the circuitry and functionality described would be apparent to one of ordinary skill in the art without departing from the scope of the invention. Accordingly, the invention is not limited to the disclosed embodiments, but rather is limited only by the scope of the appended claims.

What is claimed is:

1. An audio codec, comprising:

a bidirectional modem connection;

a microphone input;

first and second audio output channels; and an audio synthesizing circuit arranged to produce first and second synthesized audio channels;

wherein in a first mode of operation the first synthesized audio channel is applied to the first audio output channel and the second synthesized audio channel is applied to the second audio output channel; and wherein in a second mode of operation the first and second synthesized audio channels are combined into a monotonic signal and applied to the second audio output channel, and audio signals from the bidirectional modem connection are applied to the first audio output channel.

2. The codec of claim 1, wherein when operating in said second mode, audio signals from said microphone input are applied to the bidirectional modem connection.

3. The codec of claim 1, wherein said bidirectional modem connection comprises a DSP interface.

4. The codec of claim 1, further comprising:

a mixer for mixing the first and second synthesized audio channels to produce the monotonic signal;

a selecting device for selecting between an output of the mixer and the second synthesized audio channel; and a second selecting device for selecting between the first synthesized audio channel and the audio signals from the bidirectional modem connection.

5. The codec of claim 4, wherein outputs of the first and second selecting devices are applied to a digital to analog converter.

6. An audio circuit for a computer, comprising:

a CD audio input and a microphone input;

a bidirectional modem connection;

an audio codec arranged to communicate with the CD audio input, the microphone input, and the bidirectional modem connection and to generate first and second audio output channels; and an audio amplifier for amplifying the first and second audio output channels and applying the amplified first and second audio output channels to an output port;

wherein the audio codec comprises:

an audio synthesizing circuit arranged to produce first and second synthesized audio channels;

wherein in a first mode of operation the first synthesized audio channel is applied to the first audio output channel and the second synthesized channel is applied to the second audio output channel; and wherein in a second mode of operation the first and second synthesized audio channels are combined into a monotonic signal and applied to the second audio output channel, and signals from the bidirectional modem connection are applied to the first audio output channel.

7. The circuit of claim 6, wherein when operating in said second mode, audio signals from said microphone input are applied to the bidirectional modem connection.

8. The circuit of claim 6, wherein said bidirectional modem connection comprises a DSP interface.

9. The circuit of claim 6, further comprising:

a mixer for mixing the first and second synthesized audio channels to produce the monotonic signal;

a selecting device for selecting between an output of the mixer and the second synthesized audio channel; and a second selecting device for selecting between the first synthesized audio channel and the audio signals from the bidirectional modem connection.

10. The codec of claim 9, wherein outputs of the first and second selecting devices are applied to a digital to analog converter.

11. A method of simultaneously allowing speakerphone operation and generation of synthesized audio signals in an audio circuit, the audio circuit having a bidirectional modem connection, a microphone input, first and second audio output channels, and an audio synthesizing circuit, comprising the steps of:

producing first and second synthesized audio channels using the audio synthesizing circuit;

applying audio signals from the microphone input to the bidirectional modem connection;

receiving audio signals from the bidirectional modem connection;

combining the first and second synthesized audio channels into a monotonic signal and applying the monotonic signal to the second audio output channel; and applying the audio signals from the bidirectional modem connection to the first audio output channel.

12. A computer system comprising:

a central processing unit;

a modem;

a microphone;

a CD ROM drive; and an audio circuit comprising:

a CD audio input coupled to the CD ROM drive and a microphone input coupled to the microphone;

a bidirectional modem connection coupled to the modem;

an audio codec arranged to communicate with the CD audio input, the microphone input, and the bidirectional modem connection and to generate first and second audio output channels; and an audio amplifier for amplifying the first and second audio output channels and applying the amplified first and second audio output channels to an output port;

wherein the audio codec comprises:

an audio synthesizing circuit arranged to produce first and second synthesized audio channels;

wherein in a first mode of operation the first synthesized audio channel is applied to the first audio output channel and the second synthesized channel is applied to the second audio output channel; and wherein in a second mode of operation the first and second synthesized audio channels are combined into a monotonic signal and applied to the second audio output channel, and signals from the bidirectional modem connection are applied to the first audio output channel.

* * * * *